US006562537B1

(12) United States Patent
Mukataka et al.

(10) Patent No.: US 6,562,537 B1
(45) Date of Patent: May 13, 2003

(54) ELECTROSTATIC LATENT IMAGE DEVELOPER

(75) Inventors: Hisashi Mukataka, Mie (JP); Yuji Kamiyama, Mie (JP); Noriaki Sakamoto, Mie (JP); Yoshio Ozawa, Mie (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/691,561

(22) Filed: Oct. 18, 2000

(30) Foreign Application Priority Data

Oct. 20, 1999 (JP) ..... 11-298616
Sep. 26, 2000 (JP) ..... 2000-292501

(51) Int. Cl.[7] ..... G03G 9/113
(52) U.S. Cl. ..... 430/108.4; 430/108.8; 430/111.32; 430/111.35
(58) Field of Search ..... 430/111.35, 111.32, 430/108.4, 109.4, 108.8

(56) References Cited

U.S. PATENT DOCUMENTS 4,929,528 A * 5/1990 Shinoki et al. ..... 430/111.35
5,093,201 A 3/1992 Ohtani et al.
5,252,398 A 10/1993 Ohtani et al.
5,260,159 A 11/1993 Ohtani et al.
5,272,037 A 12/1993 Ohtani et al.
5,336,579 A * 8/1994 Zimmer et al. ..... 430/111.35
5,385,801 A 1/1995 Terasaka et al.
5,391,451 A 2/1995 Yoshie et al.
5,427,884 A 6/1995 Ohtani et al.
5,712,072 A * 1/1998 Inaba et al. ..... 430/108.4
5,731,120 A * 3/1998 Tanigami et al. ..... 430/111.35
5,795,691 A 8/1998 Yamazaki et al.
5,942,364 A * 8/1999 Anno et al. ..... 430/108.1
6,236,829 B1 * 5/2001 Uehara et al. ..... 399/323

FOREIGN PATENT DOCUMENTS

EP 001016933 A2 * 7/2000

OTHER PUBLICATIONS

Grant, Roger et al. Chemical Dictionary. New York: McGaw–Hill, Inc. p. 116.*

* cited by examiner

*Primary Examiner*—Christopher Rodee
(74) *Attorney, Agent, or Firm*—Hogan & Hartson, LLP

(57) ABSTRACT

An electrostatic latent image developer is provided which has an improved durability and a longer life-time by preventing the toner spent. The electrostatic latent image developer comprises a resin-coated magnetic carrier and a toner. Said resin-coated magnetic carrier consists of a magnetic ferrite carrier core and a coating layer formed thereon by polymerizing a high molecular weight polyethylene resin directly on the surface of said carrier core. Said toner does not contain polyethylene wax but polypropylene wax and/or polyester wax having an average molecular weight of 10,000 as the wax component or components in an amount of from 0.1 to 20 wt. %.

13 Claims, 3 Drawing Sheets

ELECTROSTATIC LATENT IMAGE DEVELOPER

BACKGROUND OF THE INVENTION

1. Field of the Invention

The present invention relates to an electrostatic latent image developer (also simply referred to as a "developer") which can be used for electrostatic systems such as an electro-photographic printing system, an electrostatic recording system and an electrostatic printing process employed in, for example, copying machines and laser printers.

2. Description of the Related Art

Recently, a two-component developing system has been widely applied to a color printing system. Such two-component developing system involves a developer which comprises the proper amounts of magnetic carrier particles and an electrically insulting non-magnetic toner. Such an electrically insulting non-magnetic toner generally contains a polyester resin as a binder since the polyester resin has an excellent affinity for pigments, as described in JP-A-7-114204.

However, an excess amount of such polyester resin-containing toners may cause the undesirable staining on the non-imaging region of a transfer paper after transferred to a fuser roller, resulting in so-called "offset" phenomena.

Therefore, such toners generally included a releasing agent, which may mainly comprise a polyethylene wax, a mixture of a polyethylene wax and a polypropylene wax, and a Fischer-Tropsch wax which is made from a coal, in order to improve the releasing property of a toner and the better toner fixation to a printing medium at lower temperature.

Further, a polypropylene wax may disadvantageously reduce the fixing property of the toner at lower temperature since a polypropylene resin has a melting point of as high as 130° C. or higher as disclosed in, for example, JP-A-8-231640. In short, a toner containing only a polypropylene wax can be hardly fixed to a printing media at lower temperature. Alternatively, the amount of polypropylene wax to be contained in a toner must be extremely limited when the toner contains a polypropylene resin in combination with a polyethylene wax.

Therefore, in JP-A-11-272009, JP-A-11-15197, JP-A-10-123753, JP-A-8-82952 and JP-A-5-313493, it was suggested to add either a polypropylene wax having a low molecular weight or a uniform molecular weight, or both polypropylene wax and polyethylene wax to a binder resin and colorant in order to prevent the reduction in the fixing property of a toner at lower temperature.

However, neither that the toner containing a polypropylene wax can be used in combination with a resin-coated magnetic carrier having a coating layer produced by polymerizing a polyethylene resin directly on the surface of the carrier (described below) nor that such combination can provide the unique advantages was mentioned in any of these applications.

Alternatively, JP-A-2000-10337 and JP-A-11-282194 disclosed the toners in which a polyester wax is contained in both a binder resin and a colorant.

However, the toner disclosed in JP-A-2000-10337 had a disadvantage that some particular ester waxes having iodine number of 25 or less and saponification number of from 30 to 300 must be employed since the polyester wax is susceptible to oxidization. Further, the toner disclosed in JP-A-11-282194 had a disadvantage that fatty acid metal salt must be added in the same amount as that of polyester wax added due to the poor disperse-ability of a polyester wax.

In short, neither JP-A-2000-10337 nor JP-A-11-282194 could overcome these disadvantages since these inventions did not take into account the type of the carrier to be used for the toner.

On the other hand, the magnetic resin carriers which comprises the magnetic granule dispersed in a binder resin have been employed as a carrier in a two-component developing system in order to prevent the toner filming on the surface of the carrier, to form a uniform surface on the carrier, to improve the moisture resistance, to prevent the damage of photoreceptor by the carrier, and to provide a charge controlling ability, as disclosed in JP-A-1-282564 and JP-A-2-69770.

Such magnetic resin carriers, however, disadvantageously had a poor durability since the binder resin tends to be separated from the carrier after long-time use due to the poor binding force between the magnetic granules and the binder resin.

Accordingly, the resin-coated magnetic carrier is suggested to improve the durability of the carrier in JP-A-9-204075. The resin-coated magnetic carrier comprises the magnetic granules as the carrier core and a coating layer of a high molecular weight polyethylene resin on the surface of the magnetic granules. The coating layer may be formed by polymerizing a ethylene monomer directly on the surface of the magnetic granules by utilizing the catalysts carried on the surface of the magnetic granules. Thus, the obtained polyethylene layer has an excellent strength and the proper resiliency so that the layer can absorb impact such as stir, thus providing the better durability.

However, a two-component developing system which involves a developer comprising a toner containing the above-described wax and a resin-coated magnetic carrier (hereinafter simply referred to as a "carrier") had the higher possibility of the toner spent. In short, since a polyethylene resin or the like is contained in both of the toner and the carrier, the toner has an enhanced affinity for a carrier and thus tends to adhere to the carrier through the polyethylene wax or the like. Further, such resin-coated magnetic carrier had a disadvantage that it has a polyethylene coating layer formed on all the surface of the carrier core granules so that the polyethylene wax-containing toner is more adhered to the carrier.

Such toner spent will cause the decreasing of the charging ability, which possibly result in fogging and the decreasing of the image density. Therefore, such developer cannot have a prolonged life-time even if it comprises a carrier with a high durability.

SUMMARY OF THE INVENTION

The present invention was developed for solving the above-described problems. Thus, the present invention provides an electrostatic latent image developer which comprises a resin-coated magnetic carrier and a toner, wherein: said resin-coated magnetic carrier comprises a magnetic carrier core and a coating layer produced by polymerizing a polyethylene resin directly on the surface of the carrier core (a direct polymerization); and said toner contains either or both of a polypropylene wax and a polyester wax as a main wax component without substantially using a polyethylene wax.

Accordingly, the object can be achieved by the present electrostatic latent image developer that enables to prevent the toner spent as well as to maintain the excellent image density and T/C (toner/carrier) property over a long period of time even when the resin-coated magnetic carrier having a polyethylene coating layer is used.

Although it has conventionally been said that the toner containing a polypropylene wax had reduced the fixing property at lower temperature, it has been shown that this problem can be resolved by additionally using another particular type of the resin-coated magnetic carrier and adjusting the molecular weight of the resin or the like.

Also, though it has traditionally been said that charge control of toner containing polyester wax was difficult since polyester tends to be oxidized easily, it has been shown that this problem can be resolved by additionally using another particular type of the resin-coated magnetic carrier or by using a polypropylene wax in combination.

Other futures of the present inventions are described and recognized easily from the descriptions in the sub-claims.

DETAILED DESCRIPTION OF THE INVENTION

Figure 1:
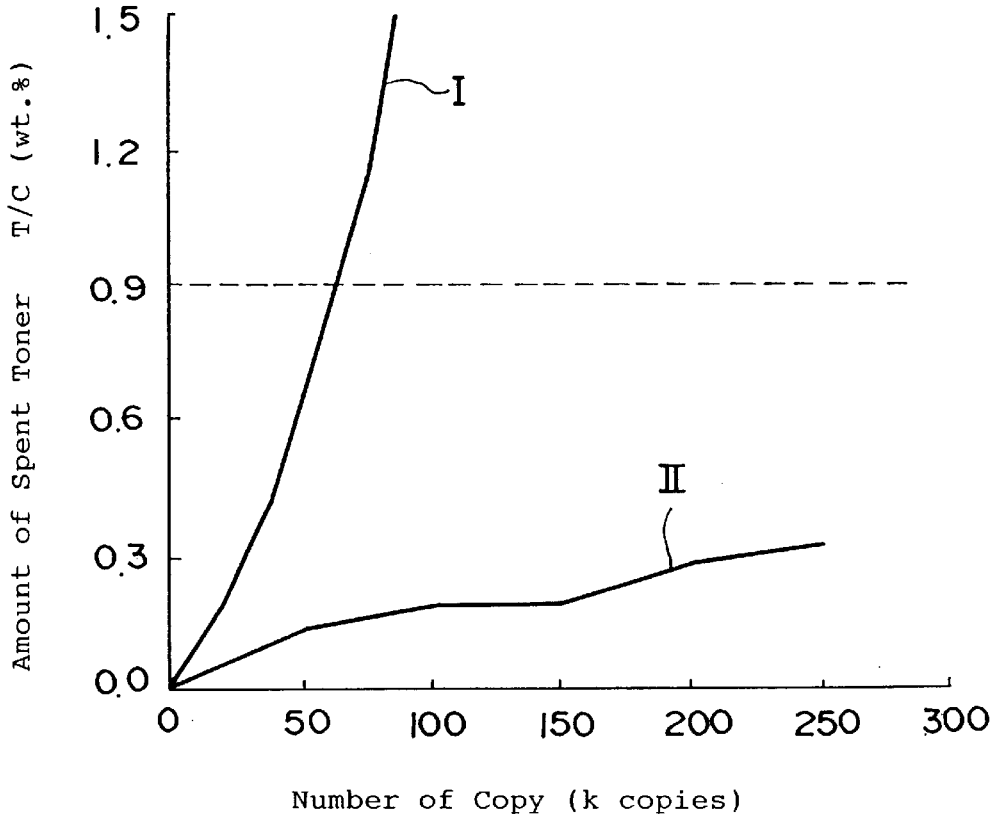
FIG. 1 is a diagram showing the amount of spent toner.

One embodiment of the present invention is an electrostatic latent image developer that comprises a resin-coated magnetic carrier and a toner, wherein the resin-coated magnetic carrier consists of a magnetic carrier core and a coating layer formed on the surface of the carrier core by polymerizing a high molecular weight polyethylene resin directly thereon, and wherein the toner does not substantially contain polyethylene wax, but either or both a polypropylene wax and a polyester wax as the wax component.

[I] Resin-coated Magnetic Carrier

1. Carrier Core Material (1) Material

As a material of the carrier core material for the present invention, well known materials for the two component-system carrier for electrophotography can be used, such as i) ferrite, magnetite, or the like; metals such as iron, nickel, and cobalt, ii) an alloy or a mixture of these metals in i) with a metal such as copper, zinc, antimony, aluminum, lead, tin, bismuth, beryllium, manganese, magnesium, selenium, tungsten, zirconium, and vanadium, iii) a mixture of the above-mentioned metals in i) with a metal oxide such as iron oxide, titanium oxide, and magnesium oxide, a nitride such as chromium nitride and vanadium nitride; a carbide such as silicon carbide and tungsten carbide, iv) ferromagnetic ferrite, and v) a mixture of these materials in i) to iv).

(2) Shape and Particle Diameter

No particular restriction is placed on the shape of the carrier core material and any of a globular form, undefined form and the like may be adopted. However, in view of the uniform charge of the carrier core material with ease, a globular form is preferable.

Also, with respect to the average particle diameter of the carrier core material, a carrier core material having an average particle diameter of 20 to 120 $\mu$m is preferably, and more preferably of 25 to 80 $\mu$m. This is because if the average particle diameter is less than 20 $\mu$m, there is the case where the adhering (scattering) of a carrier to an electrostatic latent image supporting body (light sensitive body in general) is caused when the carrier is formed. If the average particle diameter is more than 120 $\mu$m, there is the case where carrier streaks and the like are produced when the carrier is formed, resulting in deteriorated image qualities (deteriorated image density).

(3) Ratio of Formulation

The weight ratio of the carrier core material per the overall carrier is preferably set to 90 wt. % or higher, more preferably to 95 to 99 wt. %. If the weight ratio is lower than 90 wt. %, there is the case that a power of the magnetism is deteriorated, so that conveying property of the toner may be deteriorated.

Also, the weight ratio of the carrier core material per the overall indirectly specify the thickness of the resin-coated layer of the carrier. Therefore, if the weight ratio is lower than 90 wt. %, there is the case that the coating layer may become too thick or uneven, and the durability and the stability of charge which are required for a developer might not be satisfied because of exfoliation of the coating layer and the increase in the charge quantity. Further, if the weight ratio is lower than 90 wt. %, it may cause troubles such as low reproducibility in fine lines and the decrease in image density with respect to the quality of image. With respect to the upper limit of the ratio of the formulation, such a ratio may be enough that the coated resin layer can completely cover the carrier core material and the magnetic powder. More preferable ratio may be concretely 99.5 wt. % or lower, and further more preferable ratio may be 99.0 wt. % or lower. This value depends on the physical properties of the carrier core material and the method for coating.

(4) Electroconductive Layer

An electroconductive layer whose resistivity is in the range of $1\times10^{2}$ to $1\times10^{10}$ $\Omega\cdot$cm may preferably be formed on the carrier core material particles prior to coating with a high molecular weight polyethylene resin. The formation of such an electroconductive layer provide a superior developing property and clear images having the high image density and clear contrast. The reason for this is considered that the existence of the electroconductive layer lowers electro-resistance of the carrier to a suitable level to balance leak and accumulation of electric charge.

As the kind of electroconductive layer, one in which electroconductive fine particles are dispersed in an appropriate binding resin, is favorable. As these electroconductive fine particle added, the followings can be used: carbon black such as carbon black and acetylene black, carbide such as SiC, magnetic powder such as magnetite, $SnO_2$, and titanium black.

On the other hand, with respect to the binding resin of the electroconductive layer, the followings can be used: polystyrene-based resins, poly(metha)acrylic acid-based resins, polyolefin-based resins, polyamide-based resins, polycarbonate-based resins, polyether-based resins, polysulfonic acid-based resins, polyester-based resins, epoxy-based resins, polybutyral-based resins, urea-based resins, urethane-based resins, silicone-based resins, and fluorine-based resins, and the like, which may be used either singly or in combination of two or more. Further, a mixture, a copolymer, a block polymer, a graft polymer, and a blended polymer of these resins also can be used.

With respect to an average particle size, an amount to be added, and the like of the electroconductive fine particle, there is no limitation in the condition that the carrier obtained finally satisfied the characteristics such as electro-resistance and the like. For example, with respect to the average particle size, it should be one that allows homogeneous dispersion in the above-mentioned resin solution, and it should concretely be of 0.01 to 2 μm, preferably of 0.01 to 1 μm.

With respect to the amount of the electroconductive fine particles to be added, though it also depends on the kind and other factors. Even if it is not specified, a weight ratio of 0.1–60 wt. % per the binding resin of the electroconductive layer, is preferably in the range of 0.1–40 wt. %.

Although such a trouble occurs that the reproducibility decreases when fine lines are copied repeatedly using a carrier like this when the packing ratio of the carrier is as small as ca. 90 wt. % and the thickness of the coating layer is relatively thick, this kind of trouble can be dissolved by adding the above-mentioned electroconductive fine particles.

With respect to the forming ways of the electroconductive layer, it is not limited to the special way, but it may be formed by coating a liquid in which the electroconductive fine particles are dispersed in the appropriate binding resin onto the surface of the carrier core material particles by a method such as the spray coating method and the dipping method. In addition, it may also be formed by directly polymerizing a monomer on the surface of the core material particle in the presence of the electroconductive fine particles. Incidentally, the carrier core material particle having a functional layer such as an electroconductive layer is also designated hereinafter simply as "carrier core material particles".

2. Coating Layer Comprising a High Molecular Weight Polyethylene Resin (1) High Molecular Weight Polyethylene Resin High molecular weight polyethylene resins, which are usually called "polyethylene", having preferably a weight average molecular weight of 50,000 or more (number average molecular weight of 10,000 or more), more preferably of 50,000 to 500,000, and most preferably of 200,000 to 500,000 are used in the present invention. If the weight average molecular weight is less than 50,000, although the polyethylene resin turned to be wax form, so that the coating of the carrier core material is possible by usual penetration method or spray method after dissolving in the hot toluene, there is the case where the coating layer is peeled off from the core material by shearing force produced in a developing machine for the weakness of the mechanical strength of the resin when the carrier is used for a long time.

Incidentally, the electroconductive fine particles, the charged fine particles having the charge control ability and the like, which may be used either singly or in combination of two or more are preferably added to the coating layer comprising a high molecular weight polyethylene resin.

(2) Coating Layer (i) Method for Forming

With respect to the method for forming of the coating layer comprising a high molecular weight polyethylene resin, the direct polymerization method is preferably adopted. The combination of the direct polymerization method with other methods such as the dipping method, the fluidized bed method, the dry-type method, and the spray dry method is also preferable.

Here, "the direct polymerization method" is a method to produce a polyethylene resin-coated carrier by treating the surface of the carrier core material with an ethylene-polymerizing catalyst in advance and directly polymerizing ethylene (forming polyethylene) on the surface of the carrier core material. In short, this method is the method to form the polyethylene resin-coated layer by suspending a product as a catalyst for ethylene polymerization that is obtained in advance by contacting a highly active catalytic component that contains both or either titanium and zirconium, and is soluble in a hydrocarbon solvent, such as hexane and heptane, with the carrier core material, and an organoaluminum compound in the above-mentioned hydrocarbon solvent, supplying an ethylene monomer, and polymerizing it on the surface of the carrier core material.

According to this production method, a polyethylene-coated layer may be directly formed on the surface of the carrier core material, so that the coating layer thus obtained is excellent in strength and elasticity as well as thin and the durability of the carrier is excellent too.

With respect to the direct polymerization method, fore example, it is mentioned in JP-A-60-106808, and JP-A-2-187770 in detail, and the same method described thereto may be used.

In addition, in case fine particles or electroconductive fine particles having an electric charge-conferring function are added, they may be coexisted while the coating layer formation by adding to the ethylene monomer.

Also, if the functional fine particles such as electroconductive fine particles and fine particles having an ability to control an electric charge are dispersed in the polymerization system, while a high-molecular-weight polyethylene resin coating is being formed by the polymerization, these functional fine particles are incorporated into this coating, and a high-molecular-weight polyethylene resin coat containing the functional particles is easily formed.

(ii) Amount of Coating

A high-molecular-weight polyethylene resin coat is formed with a weight ratio of [high-molecular-weight polyethylene resin coat]/[carrier core material particle] being preferably in a range of 0.5/99.5 to 10/90, more preferably in a range of 1/99 to 5/95. If the weight ratio is larger than 10/90, there is the case that the coating layer may become relatively thick, and the stability of charge might not be satisfied because of exfoliation of the coating layer. Also it may cause troubles such as low reproducibility in fine lines and decrease in image density with respect to the quality of image. On the other hand, if the weight ratio is lower than 0.5/99.5, there is the case that the coating layer may become relatively thin, so that it may be difficult that the coated resin layer can completely coat the carrier core material and the magnetic powder.

(iii) Silica Particle

Preferably, a silica particle, which surface was hydrophobically treated and positively or negatively charged, may also be added to the coating layer.

Such an addition of silica particle may provide an easy control of the charged carrier and improve a mechanical strength of the coating layer.

Also the average particle size is preferably equal to or smaller than 40 nm in primary size, more preferably 10 to 30 nm. If the size is larger than 40 nm, gaps between silica particles may become large and ruggedness is generated on the surface of the carrier, so that the fluidity is decreased.

As positively charged silica, for example, R812, and RY20 (both manufactured by Nippon Aerosol Co., Ltd.), 2000, and 2000/4 (both Wacker Chemicals Co.; Ltd.) are commercially available.

When increasing the charge amount of a positively charged toner, it is preferable that negatively charged silica particle may be used, and when decreasing the charge amount of the toner, it is preferable that a silica particle having the same polar with the toner may be used.

(iv) Functional Fine Particle

Next, a functional fine particle other than the silica particle will be explained. It is preferable to modify the property of the coating layer by adding the electroconductive fine particles and charged particles having an ability to control electric charge which may be used either singly or in combination of two or more.

As the electroconductive fine particle added to the electroconductive layer, the known materials as followings can be used: carbide such as carbon black and SiC, a magnetic powder such as magnetite, $SnO_2$, and titanium black.

Also, as the charging particles, the following negatively charged resins (A) and positively charged resins (B) can be used.

A. Negatively Charged Resins

Fluorine-based resin (such as a fluorovinylidene resin, a tetrafluoroethylene resin, a trifluorochloroethylene resin, and a tetrafluoroethylene/hexafluoroethylene copolymer resin), a vinyl chloride-based resin, and celluloid.

B. Positively Charged Resins

An acryl resin, a polyamide-based resin (such as nylon-6, nylon-66, and nylon-11), a stylene-based resin (polystylene, ABS, AS, and AAS),a chlorovinylidene resin, a polyester-based resin (such as polyethylene terephthalate, polyethylene naphthalate, polybutylene terephthalate, polyacrylate, polyoxybenzoyl, and polycarbonate), a polyether-based resin (such as polyacetal and polyphenylene ether), and an polyethylene-based resin (such as EVE, EEA, EAA, EMAA, EAAM, and EMMA).

3. Electroconductivity

With respect to an electroconductivity of a carrier, an optimal electroconductivity of a carrier depends on the system of the developer in which the carrier is used, for example, a carrier having a value of $1\times10^2$ to $1\times10^{14}$ Ω·cm as a resistance value is preferred, and a value of $1\times10^2$ to $1\times10^{10}$ Ω·cm is more preferred.

If the above-value is lower than $1\times10^2$ Ω·cm, a carrier development phenomenon or an overlapping phenomenon may occur. If the above-value is higher than $1\times10^{14}$ Ω·cm, deterioration in the quality of image such as lowering of the image density may occur.

Note that resistance values can be determined by placing a carrier layer having an electrode area of 5 $cm^2$, a load of 1 kgf, and a thickness of 0.5 cm, applying a voltage of 1 to 500V to both upper and lower electrodes, measuring the current values flowing, and converting the values.

4. Average Particle Size

There is no particular limitation to the average particle size of the carrier, however, a size of 20 to 120 μm is preferable, 20 to 100 μm is more preferable, and 20–80 μm is further preferable. If the size is smaller than 20 μm, there is the case that a carrier development phenomenon or an overlapping phenomenon may occur. If the size is larger than 120 μm, there is the case that conveying ability of the carrier may be deteriorated.

5. Magnetic Carrier Granules

Preferably, in addition to the above-described resin-coated magnetic carrier(s), magnetic carrier granules substantially consisting of magnetic granules may also be added to the developer. Such an addition of the magnetic carrier granules may provide an electrostatic latent image developer that has a longer life-time and enables to show the stable image-forming and the wider range of the charging control.

Examples of such magnetic carrier granules are those substantially consisting of magnetic granules such as iron, magnetite or ferrite.

Further, the magnetic carrier granules may desirably have higher apparent density than that of the resin-coated magnetic carrier. Preferably, for example, the resin-coated magnetic carrier has an apparent density of less than 2.3 $g/cm^3$ while the magnetic carrier granules have an apparent density of 2.3 $g/cm^3$ or higher.

The resin-coated magnetic carrier and the magnetic carrier granules may preferably be mixed in a weight ratio ranging from 75/25 to 50/50.

Further, the electrostatic latent image developer may preferably comprise the resin-coated magnetic carrier, the magnetic carrier granules and the toner in a ratio of 60 to 80:40 to 20:4 to 6 by weight.

6. Second Resin-coated Magnetic Carrier

Preferably, the developer may also include, besides the above-described resin-coated magnetic carrier (also hereinafter referred to as a first resin-coated magnetic carrier), the another resin-coated magnetic carrier (also referred to as a second resin-coated magnetic carrier) which comprises magnetic granules having a coating layer of the resin selected from the group consisting of a silicon-based resin, a fluorine-based resin, an epoxy resin, a polyester resin, an acrylic resin, a polyamide resin, a styrene resin, a polyvinylidene chloride resin, a polyether resin and a polyethylene resin.

Thus, by adding the second resin-coated magnetic carrier, an electrostatic latent image developer can be obtained that has the better moisture resistance and the longer life-time as well as enables to show the stable image-forming and the wide range of charging control.

More preferably, the developer may contain a resin-coated magnetic carrier which is coated with, among the above-described resins, the releasing resins consisting of either or both of a silicone-based resin and a fluorine-based resin. By adding such second resin-coated magnetic carrier, an electrostatic latent image developer may be obtained that has a longer life-time and enables to show the more stable image-forming and the wide range of charging control.

Preferably, the coating resin such as a silicone-based resin or a fluorine-based resin may be present in an amount of from 0.1 to 50 wt. % of the total amount of the second resin-coated magnetic carrier.

This is because otherwise the range of charging control may be reduced. Therefore, the coating resin may more preferably be present in an amount of from 0.5 to 30 wt. %, and most preferably from 1 to 20 wt. %.

Preferably, the second resin-coated magnetic carrier may have the same apparent density and mixing ratio as those of the above-described magnetic carrier granules. In short, the second resin-coated magnetic carrier desirably has a higher apparent density than that of the first resin-coated magnetic carrier. Particularly, the first resin-coated magnetic carrier may have an apparent density of less than 2.3 $g/cm^3$ while the second magnetic carrier granules may have an apparent density of 2.3 $g/cm^3$ or higher.

Further, the first and second resin-coated magnetic carriers may preferably be present in a ratio ranging from 75/25 to 50/50 by weight.

Alternatively, the electrostatic latent image developer may comprise the first and second resin-coated magnetic carriers and the toner, preferably in a ratio of 60 to 80:40 to 20:4 to 6 by weight.

[II] Toner

1. Components (1) Binder Resin

Preferable examples of the binder resins to be contained in the toner may include, polystyrene resins such as polystyrene, styrene-butadiene copolymer and styrene-acrylic copolymer; ethylene copolymers such as polyethylene, ethylene-vinyl acetate copolymer and ethylene-vinyl alcohol copolymer; an epoxy resin; a phenol resin; an acrylic phthalate resin; a polyamide resin; a polyester resin; and a maleic resin.

Most preferably, a polyester resin may be used as a binder since it has the better dispersing-ability with wax ingredients (described below), pigments and the like as well as the better performance (durability) as a component of a toner.

(2) Wax (i) Polypropylene Wax

The toner may contain a polypropylene wax without essentially containing a polyethylene wax. Preferably, a toner may contain the wax which comprises polypropylene in an amount of from 0.1 to 20 wt. % of the total weight of the toner.

This is because less than 0.1 wt. % of polypropylene wax may not be insufficient to prevent contamination of the fuser roller with the toner while more than 20 wt. % of polypropylene wax may reduce uniform dispersibility of the wax into the binder resin.

Accordingly, a polypropylene wax may be present preferably in an amount of from 0.5 to 15 wt. %, and more preferably 0.1 to 10 wt. % of a toner to provide uniform dispersion and at the same time to prevent contamination of the fuser roller with the toner.

A polyethylene wax, if any, may preferably present in an amount of 1 wt. % or less, more preferably 0.5 wt. % or less, and most preferably 0.1 wt. % or less of the toner.

A polypropylene wax may be present preferably in an amount of 50 wt. % or more, more preferably 70 wt. % or more, and most preferably 90 wt. % or more of the total wax used.

This is because if the amount of the polypropylene wax is less than 50 wt. %, there is the case that the affinity of the toner for the polyethylene coating layer of a carrier is increased, resulting in more possibility of the toner spent.

Preferably, polypropylene wax may have a weight average molecular weights of 300 to 40,000 as determined by GPC when converted to that of polystyrene, though their molecular weights may preferably be determined by taking into account the handling property and the releasing-ability of a toner from the fuser roll.

This is because a polypropylene wax having a weight average molecular weight of smaller than 300 may result in more difficult handling, increased tendency of the bleeding, or enhanced the affinity of a toner for the coating layer of a carrier, which causes increased the possibility of the toner spent. On the other hand, the polypropylene wax having a weight average molecular weight of more than 40,000 may render the toner which is less separable from the fuser roll, or reduce the uniform dispersing-ability of a wax into the toner.

Thus, a polypropylene wax may preferably have a weight average molecular weight of from 500 to 30,000, and more preferably 800 to 20,000 in order to provide the improved handling and the releasing-ability of a toner from the fuser roll.

Not only conventional polypropylenes (not-modified) but also modified polypropylenes may preferably be used as wax. It is also preferable to use polypropylene wax which has any functional group such as carboxyl group (—COOH), hydroxyl group (—OH), epoxy group ($—CH_2OCH$), amino group ($—NH_3$), urethane group (—NCOO), or hydrolytic silyl group ($—Si(OCH_3)_3$) in the molecule.

This is because such modified polypropylenes can provide improved binding force between the toner and the binder resin and relatively reduced the affinity of the toner for the coating layer of the carrier.

The polypropylene wax may preferably have 0.1 to 5, more preferably 0.5 to 3, and most preferably 1 to 2 groups selected from the above-described functional groups.

(ii) Polyester Wax

Preferably, a toner may also comprise, as a wax component, polyester wax alone or in combination with polypropylene wax. Adding polyester wax may reduce the affinity of the toner for the coating layer of the carrier and thus efficiently prevent the toner spent. Further, since toners typically contain a polyester resin as a binder resin, the toner may have improved the affinity for a polyester wax and thus relatively less affinity for the coating layer of a carrier. Moreover, though a polyester wax is susceptible to oxidization and thus makes charging control of a toner difficult, these problems regarding a polyester wax can be resolved by using in combination with the resin-coated magnetic carrier having a coating layer formed by polymerizing a polyethylene resin directly on the surface of the carrier core material, or by using a polyester wax in a mixture with polypropylene wax.

When a polyester wax is used in combination with a polypropylene wax, the polyester wax is preferably present in an amount of from 1 to 50 wt. %, more preferably from 2 to 30 wt. %, and most preferably from 3 to 20 wt. % of the total amount of wax to be used.

With respect to the amount of the polyester wax, it may be the same as the amount of the polypropylene wax. Therefore, a explanation for this will be omitted.

Preferably, a polyester wax may have a weight average molecular weights of 300 to 5,000 as determined by GPC when converted to that of polystyrene, though their molecular weight may preferably be determined by taking into account the handling property and the releasing-ability of a toner from the fuser roll.

This is because a polyester wax having a weight average molecular weight of smaller than 300 may result in more difficult handling, increased tendency of the bleeding, or enhanced the affinity of a toner for the coating layer of a carrier, which causes increased possibility of the toner spent. On the other hand, the polyester wax having a weight average molecular weight of more than 5,000 render the which is less separable from the fuser roll, or reduce the uniform dispersing-ability of the wax into the toner.

Thus, a polyester wax may preferably have a weight average molecular weight of from 500 to 3,000, and more preferably 800 to 2,000 in order to provide improved the handling-ability and the releasing-ability of a toner from the fuser roll.

Preferably, a polyester wax may have a melting point (peak melting temperature) of 75 to 90° C. measured by DSC.

This is because a polyester wax having a melting point of smaller than 75° C. may result in the deterioration of the heat resistance or more difficult handling at the room temperature. On the other hand, the polyester wax having a melting point of more than 95° C. may reduce the uniform dispersing-ability of a wax into a toner or deteriorate the fusion ability of the toner.

Thus, a polyester wax may preferably have a melting point in the range of 77 to 88° C., and more preferably 80 to 85° C.

As a polyester wax, a crystalline polyester resin may preferably be used. Such a crystalline polyester resin provide a toner which improve the heat resistance or the handling at the room temperature. However, when the polyester resin is excessively crystallized, there is the case that the fusion ability of the toner will be deteriorated.

Thus, the crystalline polyester resin may preferably have a crystallinity in the range of 0.1 to 30 wt. %, more preferably of 0.5 to 20 wt. %, and most preferably of 1 to 10 wt. %.

Incidentally, the crystallinity of the polyester wax may be measured by using an X-ray diffraction measurement apparatus.

(3) Coloring Agents

With respect to the coloring agent which is added to the toner, the pigment is preferably used in view of the superior chromogenicity and durability. Specific examples of the pigment include carbon black, Phthalocyanine Blue, Indus Melia Blue, Peacock Blue, Permanent Red, Red Oxide, Alizarin Rake, Chrome Green, Malachite Green Rake, Methyl Violet Rake, Hansa Yellow, Permanent Yellow, and titanium oxide, and the like, which may be used either singly or in combination of two or more.

(4) Electric Charge-controlling Agents

Electric charge-controlling agents such as positive electric charge-controlling agents or negative electric charge-controlling agents are preferably added to the toner in view of the controlling of the charging characteristics with ease. Specific examples of the positive electric charge-controlling agent include quaternary ammonium salt, nigrosin, nigrosin base, triphenylmethane-based compounds, polyvinylpyridine, and the like, which may be used either singly or in combination of two or more.

Also, specific examples of the negative electric charge-controlling agent include metal-complexes of alkyl-substituted salicylic acid (e.g. a chromium complex or a zinc complex of di-tert-butylsalicylic acid), and the like, which may be used either singly or in combination of two or more.

(5) Fluidizing Agents

Fluidizing agents are preferably added to the toner in view of the improvement of the liquidity and the uniform mixing with the carrier. Specific examples of the lubricant include tetrafluoroethylene (Teflon), zinc stearate, polyfluorovinylidene, and the like, which may be used either singly or in combination of two or more.

(6) Magnetic Materials

In the case of the monochrome toner, magnetic materials are preferably added to the toner in order to prepare the magnetic toner. Such a magnetization of the toner may improve a developing property and prevent scattering of the toner in the printer.

As a magnetic materials to be added, magnetite, ferrite, and the like are preferably used.

2. The Average Size of the Toner

Though no particular limitation is imposed on the average size of the toner, such a average size, for example, is preferably equal to or lower than 20 $\mu$m, more preferably of 3 to 18 $\mu$m and most preferably of 5 to 15 $\mu$m. This is because if the average size of the toner is more than 20 $\mu$m, there is the case where the carrier phenomenon or the toner overlapping is occurred.

3. The Method for Production of the Toner

With respect to the method for the production of the toner in the present invention, well known methods such as the suspension polymerization method, the crushing method, the encapsuling (microcapsuling) method, the spray dry method, and the mechanochemical method may be preferably used.

4. Mixing Ratio

The mixing ratio of the toner in the developing agent is designed to be in a range of 2 to 40% by weight, preferably of 3 to 30% by weight, and more preferably of 4 to 20% by weight based on 100 parts by weight of the total amount of the carrier and the toner. This is because if the mixing ratio of the toner is 2% or more by weight, it is possible to suppress the deterioration of the image density based on the excessively increased charge quantity of the toner. On the other hand, if the mixing ratio is 40% or less by weight, it is possible to suppress the generation of the toner scatters from a developing unit to thereby soil the inside of the machine and the toner overlapping based on the insufficient charge quantity.

5. Usage

The developer according to this embodiment is suitably used in the 2-component-type electrophotography system such as the copying machine (analogue, digital, monochrome, and color type), the printer (monochrome and color type), and the facsimile, especially most suitably in the high-speed copying machine and printer or the like in which the stress applied to the developer is high in the developing machine in view of the superior durability of the developer.

Also there is no particular limitation to the type of image-formation, the type of exposure, the type of development, and various types of control (e.g. the type of controlling the density of a toner in a developing machine). According to the kind of types adopted such as the type of image-formation and the like, a resistance, a particle size, a particle size distribution, a magnetic power, and an charge quantity of the carrier and the toner may be adjusted suitably.

EXAMPLES

Example 1

(1) Production of the Resin-coated Magnetic Carrier (i) Preparation of the Titanium-containing Catalytic Component Into a 500-ml flask whose atmosphere was replaced for argon, 200 ml of dehydrated n-heptane and 15 g (25 mmol) of dehydrated magnesium stearate that had been dried at 120° C. under a reduced pressure (2 mmHg) were added at room temperature to make a slurry. After 0.44 g (2.3 mmol) of titanium tetrachloride was added dropwise with stirring, the content began to be heated, the reaction was carried out under reflux for 1 hour, and a clear viscous solution of a titanium-containing catalyst (the active catalyst) was obtained.

(ii) Evaluation of Activity of the Titanium-containing Catalytic Component

Into a 1-liter autoclave whose atmosphere was replaced for argon, 400 ml of dehydrated hexane, 0.8 mmol of triethylaluminum, 0.8 mmol of diethylaluminun chloride, and 0.004 mmol (as titanium atom) of the titanium-containing catalytic component prepared in (i) were added respectively, and the content was heated up to 90° C., wherein the inner pressure of the autoclave was 1.5 kg/cm$^2$G. Subsequently, after hydrogen was supplied to 5.5 kg/cm$^2$G, ethylene was continuously supplied maintaining the total pressure at 9.5 kg/cm$^2$G. Polymerization was carried out for 1 hour, giving 70 g of polymer. The polymerization activity was 365 kg/g·Ti/Hr, and MFR (melt flow rate at 190° C., a loading of 2.16 kgf according to JIS K 7210) of the polymer obtained was 40 g/ min.

(iii) Production of Carrier Coated with Polyethylene 960 g of a sintered ferrite powder F-2535 (manufactured by Powdertech, average particle diameter: 65 $\mu$m) was placed in an autoclave with an inner volume of 2 little which was replenished with argon and thereafter the temperature was raised to 80° C. to dry the powder under reduced pressure (10 mmHg) for one hour. Then the temperature was dropped down to 40° C. and 800 ml of dehydrated hexane was added to start stirring.

Next, 5.0 mmol of diethylaluminum chloride and the titanium-containing catalyst component of the above (i) (0.05 mmol as converted into a titanium atom) were added to run a reaction for 30 minutes, further the temperature was raised to 90° C. and ethylene was introduced to indicate the internal pressure to 3.0 kg/cm$^2$G. Thereafter, hydrogen was supplied to raise the internal pressure to 3.2 kg/cm$^2$G, and 5.0 mmol of triethylaluminum was added to start polymerization. Then the internal pressure was decreased to 2.3 kg/cm$^2$G in about 5 minutes and became stable.

Then, a slurry containing 5.5 g of carbon black (Mitsubishi Chem. Co., MA-100) in 100 ml of dehydrated hexane was added into the autoclave, and ethylene was successively supplied so as to keep the internal pressure of 4.3 kg/cm$^2$G as it was to continue the polymerization for 45 minutes (the introduction of ethylene was stopped when ethylene was introduced in an amount of 40 g in total), thereby preparing ferrite coated with a polyethylene resin containing carbon black in a total amount of 1,005.5 g. The resultant dry powder of the ferrite coated with a polyethylene resin containing carbon black exhibited a uniform black color and it was found by observation using an electron microscope that the surface of the ferrite was coated with a thin polyethylene layer and the carbon black is uniformly dispersed in the polyethylene layer.

The resultant composition was measured by TGA (thermobalance) to find that the component ratio of ferrite:carbon black:polyethylene was 95.5:0.5:4.0 (ratio by weight). The weight average molecular weight of coating polyethylene in the ferrite coated with a polyethylene resin containing carbon black measured by GPC was 206,000. Then, the ferrite coated with a polyethylene resin containing carbon black was classified using a sieve of 125 $\mu$m to remove particles which are equal to or larger than 125 $\mu$m in diameter. The ferrite coated with a polyethylene resin containing carbon black after the classification was added into a fluidized-bed type gas-flow classifier having a height of 14 cm, and heated air (90° C.) was blown in to give at a linear velocity of 20 cm/s to fluidize the ferrite coated with a polyethylene resin containing carbon black for 10 hours. Thus obtained ferrite coated with a polyethylene resin containing carbon black is hereinafter designated as a primary carrier.

The resultant primary carrier 10 kg was placed in a Henshel mixer with a capacity of 20 little (FM20C/I model, manufactured by Mitsui Miike Chemical Machine Co., Ltd.). Thereafter, hot water was allowed to flow through a jacket formed around the Henshel mixer to raise the temperature (treating temperature) in the Henshel mixer to 70° C. The primary carrier was stirred for two hours with the temperature being kept at 70° C. and was applied an impact thereby smoothing the surface of the primary carrier.

Then, screening treatment (#125 mesh) and classification treatment (using a fluidized bed type air classifier, linear velocity: 20 cm, two hours) were performed to remove a fine powder generated by the Henshel mixer or a aggregated powder completely to obtain a resin-coated magnetic carrier (there is the case to be called secondary carrier).

The obtained resin-coated magnetic carrier had an average grain size of 75 $\mu$m, a resistivity of $1\times10^{10}$ $\Omega$·cm, an apparent density of 2.1 g/cm$^3$, a saturation magnetization of 62 emu/g and 130.2 emu/cm$^3$.

(2) Producing Silicone-Coated Ferrite Carrier

Besides the resin-coated magnetic carrier, silicone-coated ferrite carrier was used in the present example.

The silicone-coated ferrite carrier is produced by coating the surface of a composite ferrite consisted of $Fe_2O_3$ and CuO.ZnO with a silicone resin layer. The obtained silicone-coated ferrite carrier had an average grain size of 90 $\mu$m, 0.1 wt. % of silicone coating layer, a resistivity of $1\times10^8$ ohm-cm, an apparent density of 2.7 g/cm$^3$, a saturation magnetization of 64 emu/g and 172.8 emu/cm$^3$.

(3) Preparing Toner

In the present example 1, the grinding toner preparation was performed by sufficiently mixing and kneading the following materials in a high speed mixer, grinding the mixture and classifying the granules to obtain the toner particles having an average grain size of 10 $\mu$m.

| | |
|---|---|
| Styrene-acrylic acid n-butyl copolymer (copolymerization ratio) | 93 wt. % |
| Carbon black (MA-100 ™, available from Mitsubishi Chemical Corporation) | 4 wt. % |
| Quaternary ammonium salt | 2 wt. % |
| Polypropylene wax (NP-055 ™, a weight average molecular weight of about 10,000, available from Mitsui Chemicals) | 1 wt. % |

(4) Mixing Ratio

In Example 1, the resin-coated magnetic carrier, the silicone-coated ferrite carrier and the toner were mixed in a ratio (by weight) of 70:30:5 to obtain a developer for evaluation.

(5) Determining the Amount of Spent Toner

The developer obtained above was monitored for the amount of the spent toner by using the modified version of FS-3500™ printer available from Kyocera Corporation.

Predetermined parameters of the modified printer were as follows: the gap between the photoreceptor and the sleeve=0.6 mm; the gap between the developer controlling blade and the sleeve=0.6 mm; electric potential in the white region (non-image are) of the photoreceptor=500 V; electric potential on the photoreceptor (electrostatic latent image area) after exposure=15 V; sleeve bias voltage=350 V; and surface speed ratio of photoreceptor to sleeve=1:2.0.

The amount of the spent toner was monitored as follows:

(i) Toner TK-9 (15 mg) for FS3500 printer (available from Kyocera Corporation) was dissolved in 5 ml of THF solution and the supernatant was filtered. Then, the collected product was monitored by GPC (available from Tosoh Corporation) and the area A for the obtained molecular weight distribution was calculated.

(ii) To determine the amount of the spent toner on the surface of the carrier present in the developer during printing, only spent component of the toner was left on the surface of the carrier by sampling 2.0 g of the developer from the developer housing and aspirating to separate the toner electrostatically adhering to the carrier through a filter (#635 mesh).

(iii) Next, 2.0 g of the carrier obtained in (ii) above was dissolved in 3 ml of THF solution and the supernatant was filtered. The collected product was monitored by GPC and the area B for the obtained molecular weight distribution was calculated.

(iv) The above procedures (ii) and (iii) were repeated for 50,000 copies (hereinafter abbreviated as "50 k"), 100 k, 150 k, 200 k, 300 k, 400 k and 500 k, respectively.

(v) The amount of the spent toner on the surface of the carrier in the developer during printing was determined by calculating the ratio of area B determined in (iii) to area A determined in (i).

(vi) Finally, the amount of the spent toner per gram was calculated from the result obtained in (v) above.

Particularly, the amount of the spent toner can be given as:

$$\text{Amount of spent toner}=[\{(B/A)\cdot 100\}\cdot 15]/[2000-\{(B/A)\cdot 100\}\cdot 15]\cdot 100.$$

The results obtained above are shown in FIG. 1. The horizontal axis of the graph shown in FIG. 1 represents the number of copy (k copies) and the vertical axis represents the amount of the spent toner. The amount of the spent toner is indicated as a ratio (wt. %) of the toner to the carrier (T/C). Curve I in the graph shown in FIG. 1 is directed to the amount of the spent toner in the developer of Comparative Example 1 described below while curve II represents one in the developer of Example 1.

As seen from curve I, the amount of the spent toner increased drastically so that the amount surpassed 0.9 wt. % before the copy number reached to 100 k in Comparative Example 1. To the contrary, as seen from curve II, the amount of the spent toner increased gradually such that the amount was as low as 0.3 wt. % even after the copy number surpassed 250 k in Example 1.

Accordingly, it was proved that the developer of Example 1 can prevent increase in the amount of the spent toner over a long period of time though it contains the resin-coated magnetic carrier having a polyethylene coating layer.

Evaluation results for the amount of the spent toner are shown in Table 1 according to the following criteria:

| | |
|---|---|
| Very good (◎) | the amount of the spent toner is 0.5 wt. % or less at 250k copies; |
| Good (○) | the amount of the spent toner is 1.0 wt. % or less at 250k copies; |
| Fair (Δ) | the amount of the spent toner is from more than 1.0 to 5.0 wt. % at 250k copies; |
| Bad (X) | the amount of the spent toner is more than 5.0 wt. % at 250k copies; |

(6) Determining Image Density

Images were actually printed using the developer of Example 1 and image density was monitored. Particularly, 400 g of the developer prepared in Example 1 was accommodated in a modified version of ECOSYS FS-3500™ (available from Kyocera Corporation). Fixed parameters used were as follows: surface electric potential=400V; bias voltage=300V; temperature of fuser roller=170° C.; fusing time=$52\times10^{-3}$ sec. Solid image was printed on a number of printing papers (A4 size). The image density of the solid image was periodically monitored by using a Macbeth's densitometer.

Figure 2:
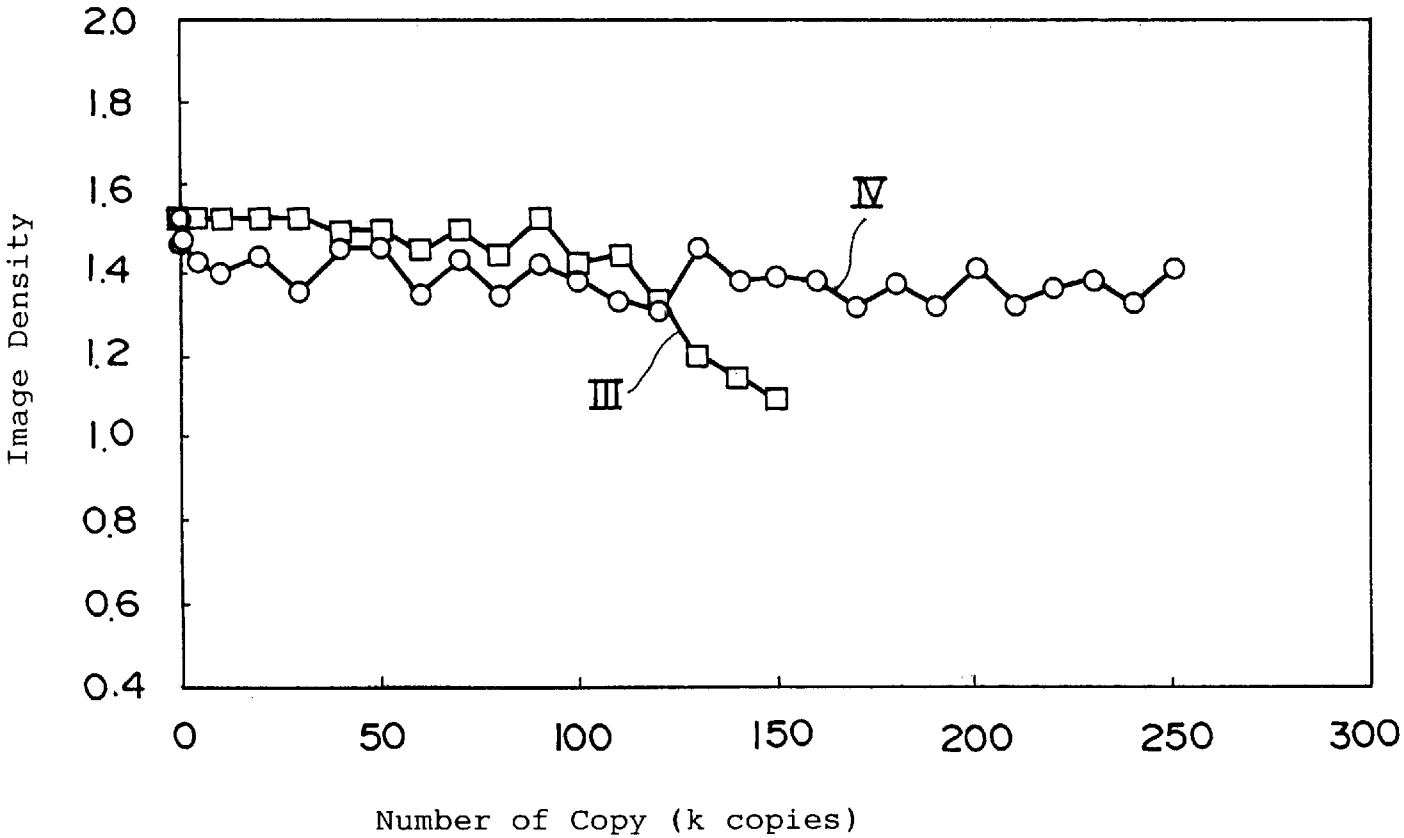
FIG. 2 shows a diagram illustrating the image density.

Thus obtained results are shown in FIG. 2. The horizontal axis represents copy number (k copies) while the vertical axis represents image density in the graph shown in FIG. 2. Curve III is directed to the image density obtained by using the developer of Comparative Example 1 described below while curve IV represents image density obtained by using the developer of Example 1 in the graph shown in FIG. 2.

As can be understood from curve III, the developer of Comparative Example 1 showed drastic decrease in image density after the copy number surpassed 100 k such that the image density dropped from about 1.5 of the initial density to about 1.0. To the contrary, the developer of Example 1 did not show any drastic decrease in the image density during the time course such that decrease in the image density was from about 1.6 of initial image density to about 1.4 which was kept after copy number surpassed 250 k, as can be understood from the curve IV.

Thus, it has been shown that the developer of Example 1 can prevent decrease in the image density over a long period of time even though it contains a resin-coated magnetic carrier having a coating layer of the polyethylene resin. It was also proved that the developer of Example 1 could provide improved initial image density when compared to that of Comparative Example 1. Evaluation for image density are shown in Table 1 according to the following criteria:

| | |
|---|---|
| Very good (◎) | image density is 1.2 or higher at 250k; |
| Good (○) | image density is 1.0 or higher at 250k; |
| Fair (Δ) | image density is 0.5 or higher at 250k; |
| Bad (X) | image density is less than 0.5 at 250k; |

(7) Determining Toner to Carrier (T/C) Ratio

The increasing of the spent toner will result in shortage of the toner available for development due to the decrease in the amount of the non-spent toner. Thus, the weight ratio of the toner to the carrier (T/C) in the developer housing was monitored by using the developer of Example 1. The results are shown in FIG. 3.

Figure 3:
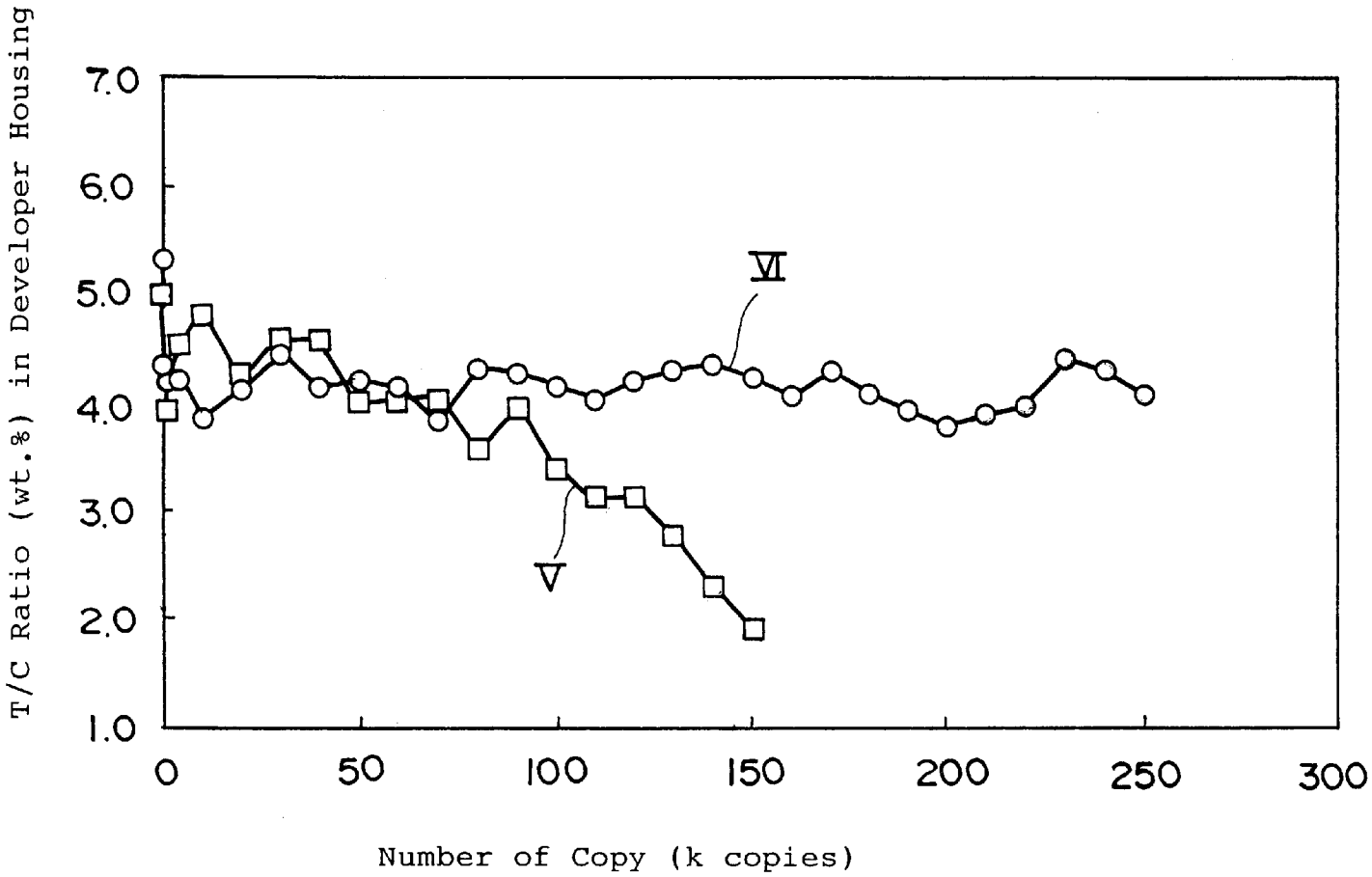
FIG. 3 shows a diagram illustrating the T/C ratio.

The horizontal axis represents copy number (k copies) while the vertical axis represents T/C ratio (wt. %) in the graph shown in FIG. 3. Curve V is directed to the T/C ratio obtained by using the developer of Comparative Example 1 described below while curve VI represents T/C ratio obtained by using the developer of Example 1 in the graph shown in FIG. 3.

As can be understood from curve V, the developer of Comparative Example 1 showed drastic decrease in T/C ratio just before copy number surpassed 100 k. To the contrary, the developer of Example 1 did not show any drastic decrease in T/C ratio such that the T/C ratio was kept at about 4.0 or higher after copy number surpassed 250 k, as can be seen from curve VI.

Thus, it has been shown that the developer of Example 1 can prevent decrease in the T/C ratio (i.e., prevent increase in the amount of the spent toner) over a long period of time though it contains a resin-coated magnetic carrier having a coating layer of a polyethylene resin.

Evaluation for T/C ratio are shown in Table 1 according to the following criteria:

| | |
|---|---|
| Very good (◎) | T/C ratio is 4.0 or higher at 250k; |
| Good (○) | T/C ratio is 3.0 or higher at 250k; |
| Fair (Δ) | T/C ratio is less than 3.0 at 250k; |
| Bad (X) | T/C ratio is less than 2.0 at 250k; |

Comparative Example 1

Effects provided by another type of wax were examined in Comparative Example 1. In short, the toner was prepared according to Example 1 except for using a mixture of the polyethylene wax (NP055, available from Mitsui Chemicals, 1 wt. %) and the polypropylene wax (2 wt. %) employed in Example 1 (mixing ratio=67:33% by weight, total 3 wt. %) to prepare a developer. Then, the amount of the spent toner, the image density and T/C ratio were determined. The results are shown in FIGS. 1–3 and Table 1.

As apparent from the results, the amount of the spent toner was more than 5.0 wt. %, the image density was less than 0.5 wt. %, and T/C was less than 2.0 at 250 k copies.

Thus, it was shown that the developer of Comparative Example 1 could hardly prevent increase in the amount of the spent toner or decrease in the image density and T/C ratio over a long period of time when it contained the resin-coated magnetic carrier having a coating layer of a polyethylene resin since the toner contained a polyethylene wax in an amount of more than the prescribed amount.

Comparative Example 2

Effects provided by another type of wax were examined in Comparative Example 2. In short, the toner was prepared according to Example 1 except for using the polyethylene wax used in Comparative Example 1 instead of the polypropylene wax employed in Example 1 to prepare a developer. In other words, developer was prepared by using the toner that contained 1 wt. % polyethylene as the wax component. Then, the amount of the spent toner, the image density and T/C ratio were determined. The results are shown in Table 1.

As a result, the increasing of the spent toner and the decreasing of the image density similar to those of Comparative Example 1 were confirmed.

Accordingly, it was shown that the developer of Comparative Example 2 could hardly prevent increase in the amount of the spent toner or decrease in the image density or T/C ratio over a long period of time when it contained the resin-coated magnetic carrier having a coating layer of a polyethylene resin since the toner contained about 1 wt. % polyethylene wax.

Example 2

Effects provided by another type of wax were examined in Example 2. In short, the toner was prepared as same in Example 1 except for using polyester wax instead of polypropylene wax to prepare a developer. Then, the amount of the spent toner, the image density and T/C ratio were determined. The results are shown in Table 1.

As apparent from the results, it was confirmed that the developer of Example 2 can provide almost the same results for the amount of the spent toner, the image density and T/C ratio as those of Example 1.

Further, it was confirmed that the developer of Example 2 could provide the sufficient toner fusing even when the fuser roller has a temperature of as low as 160° C. or less. Thus, it was confirmed that a developer containing a certain amount of polyester wax can be fused at lower temperature when compared to the developer of, for example, Example 1 which contained polypropylene wax alone.

Examples 3–8

Effects provided by various ratios (by weight) of polypropylene wax to polyester wax and different total amounts of the waxes to be added to the toner were examined in Examples 3–8. In short, the toner was prepared according to Example 1 except for using a polypropylene wax to a polyester wax ratios of 25:75 (Examples 3 and 6), 50:50 (Examples 4 and 7) and 75:25 (Examples 5 and 8) and total amounts of the wax of 3% (Examples 3–5) and 7% (Examples 6–8) to prepare developers. Then, the amount of the spent toner, the image density and T/C ratio were determined. The results are shown in Table 1.

As apparent from these results, there was no apparent difference in the amount of the spent toner, the image density or T/C ratio between any of Examples 3–8 and Example 1.

Developers of Examples 3–5 could provide the sufficient toner fixation by using a fuser roller at 160° C. and having $52\times10^{-3}$ sec. of fusing time, and developers of Examples 6–8 could provide the sufficient toner fixation by using a fuser roller at 150° C. and having $52\times10^{-3}$ sec. of fusing time. Thus, it was confirmed that a developer which contains polypropylene wax in combination with polyester wax in a relatively increased amount can be fused on a printing media at lower temperature when compared to the developer of Example 1 which contains polypropylene wax alone as the wax component.

TABLE 1

| | Type of wax | Amount of wax (% by weight) | Toner Spent | Image density | T/C |
|---|---|---|---|---|---|
| Example 1 | PP | 1 | ◎ | ◎ | ◎ |
| Example 2 | PES | 1 | ◎ | ◎ | ◎ |
| Example 3 | PP/PES | 3 (25/75) | ◎ | ◎ | ◎ |
| Example 4 | PP/PES | 3 (50/50) | ◎ | ◎ | ◎ |
| Example 5 | PP/PES | 3 (75/25) | ◎ | ◎ | ◎ |
| Example 6 | PP/PES | 7 (25/75) | ◎ | ◎ | ◎ |
| Example 7 | PP/PES | 7 (50/50) | ◎ | ◎ | ◎ |
| Example 8 | PP/PES | 7 (75/25) | ◎ | ◎ | ◎ |
| Comparative Example 1 | PP/PE | 3 (67/33) | x | x | x |
| Comparative Example 2 | PE | 1 | x | x | x |

PP: Polypropylene wax;
PES: polyester wax;
PE: polyethylene wax
Ratios indicated in brackets in the column of amount of wax represent mixing ratios shown as % by weight.

According to the present invention, as described above, a developer comprising a toner and a resin-coated magnetic carrier having high durability produced by direct polymerization can be provided that prevents the toner spent (i.e., toner fixation to carrier) for a long period of time, by taking into account the type and amount of wax or waxes to be added to the toner. In other wards, the developer of the present invention can, even when it contains a resin-coated magnetic carrier obtained by direct polymerization, control the amount of the spent toner, for example, at 0.03 mg/1 g carrier/1000 copies of A4 papers or less.

Thus, a developer having a longer life-time can be obtained by exerting the performance of the resin-coated magnetic carrier having the high durability obtained by directly polymerization according to the present invention.

Further, as described above, a developer can also be obtained that provides improved built-up charging and higher initial image density and T/C ratio as well as prevents decrease in these parameters by taking into account the type and amount of wax component(s) to be added to the toner, according to the present invention.

What is claimed is:

1. An electrostatic latent image developer comprising:

a resin-coated magnetic carrier which comprises a magnetic carrier core and a coating layer produced by polymerizing a polyethylene resin directly on the surface of the carrier core; and a toner which contains a polypropylene wax and a polyester wax as main wax components, wherein said polyethylene resin contained in said coating layer has a weight average molecular weight of from about 50,000 to 500,000.

2. The electrostatic latent image developer according to claim 1 wherein said toner comprises a binder resin having a polyester resin in an amount of 70 wt. % or more of the total amount of the binder resin.

3. The electrostatic latent image developer according to claim 1 wherein said toner comprises said wax components in an amount of from about 0.1 to 20 wt. % of the total amount of the toner.

4. The electrostatic latent image developer according to claim 1 wherein said wax components have a weight average molecular weight of from about 300 to 40,000.

5. The electrostatic latent image developer according to claim 1 wherein said toner is present in an amount of from about 2 to 40 wt. % of the total amount of the developer.

6. The electrostatic latent image developer according to claim 1 further comprising a magnetic carrier granule containing a magnetic granule.

7. An electrostatic latent image developer comprising:

a resin-coated magnetic carrier which comprises a magnetic carrier core and a coating layer produced by polymerizing a polyethylene resin directly on the surface of the carrier core;

a toner which contains a polypropylene wax and a polyester wax as main wax components; and a magnetic carrier granule containing a magnetic granule, wherein said resin-coated magnetic carrier has an apparent density of less than 2.3 g/cm$^3$ while said magnetic carrier granule has an apparent density of 2.3 g/cm$^3$ or higher.

8. An electrostatic latent image developer comprising:

a first resin-coated magnetic carrier which comprises a magnetic carrier core and a coating layer produced by polymerizing a polyethylene resin directly on the surface of the carrier core;

a second resin-coated magnetic carrier which comprises a magnetic carrier core coated with a coating layer of a resin selected from the group consisting of a silicon-based resin, a fluorine-based resin, an epoxy resin, a polyester resin, an acrylic resin, a polyamide resin, a styrene resin, a polyvinylidene chloride resin, and a polyether resin; and a toner which contains either or both of a polypropylene wax and a polyester wax as a main wax component or components.

9. The electrostatic latent image developer according to claim 8, wherein the resin in the coating layer of the second resin-coated magnetic carrier is in an amount of from 0.1 to about 50 wt. % of the total amount of the second resin-coated magnetic carrier.

10. An electrostatic latent image developer comprising:

a first resin-coated magnetic carrier which comprises a magnetic carrier core and a coating layer produced by polymerizing a polyethylene resin directly on the surface of the carrier core;

a second resin-coated magnetic carrier which comprises a magnetic carrier core coated with a coating layer of a resin selected from the group consisting of a silicon-based resin and a fluorine-based resin; and a toner which contains either or both of a polypropylene wax and a polyester wax as a main wax component or components.

11. An electrostatic latent image developer comprising:

a first resin-coated magnetic carrier which comprises a magnetic carrier core and a coating layer produced by polymerizing a polyethylene resin directly on the surface of the carrier core;

a second resin-coated magnetic carrier which comprises a magnetic carrier core coated with a coating layer of a resin selected from the group consisting of a silicon-based resin, a fluorine-based resin, an epoxy resin, a polyester resin, an acrylic resin, a polyamide resin, a styrene resin, a polyvinylidene chloride resin, a polyether resin and a polyethylene resin; and a toner which contains either or both of a polypropylene wax and a polyester wax as a main wax component or components, wherein said first resin-coated magnetic carrier has an apparent density of less than 2.3 g/cm3 and said second resin-coated magnetic carrier has an apparent density of 2.3 g/cm3 or higher.

12. An electrostatic latent image developer comprising:

a first resin-coated magnetic carrier which comprises a magnetic carrier core and a coating layer produced by polymerizing a polyethylene resin directly on the surface of the carrier core;

a second resin-coated magnetic carrier which comprises a magnetic carrier core coated with a coating layer of a resin selected from the group consisting of a silicon-based resin, a fluorine-based resin, an epoxy resin, a polyester resin, an acrylic resin, a polyamide resin, a styrene resin, a polyvinylidene chloride resin, a polyether resin and a polyethylene resin; and a toner which contains either or both of a polypropylene wax and a polyester wax as a main wax component or components, wherein the first resin-coated magnetic carrier and the second resin-coated magnetic carrier are present in a ratio ranging from 75:25 to 50:50.

13. An electrostatic latent image developer comprising:

a first resin-coated magnetic carrier which comprises a magnetic carrier core and a coating layer produced by polymerizing a polyethylene resin directly on the surface of the carrier core;

a second resin-coated magnetic carrier which comprises a magnetic carrier core coated with a coating layer of a resin selected from the group consisting of a silicon-based resin, a fluorine-based resin, an epoxy resin, a polyester resin, an acrylic resin, a polyamide resin, a styrene resin, a polyvinylidene chloride resin, a polyether resin and a polyethylene resin; and a toner which contains either or both of a polypropylene wax and a polyester wax as a main wax component or components having 60 to 80 parts by weight of the first resin-coated magnetic carrier, 40 to 20 parts by weight of the second resin-coated magnetic carrier, and 4 to 6 parts by weight of the toner.

* * * * *